US011701280B1

(12) United States Patent
Wynter

(10) Patent No.: US 11,701,280 B1
(45) Date of Patent: Jul. 18, 2023

(54) MOBILITY AID

(71) Applicant: Andrene Wynter, Palm Bay, FL (US)

(72) Inventor: Andrene Wynter, Palm Bay, FL (US)

( * ) Notice: Subject to any disclaimer, the term of this patent is extended or adjusted under 35 U.S.C. 154(b) by 0 days.

(21) Appl. No.: 17/580,850

(22) Filed: Jan. 21, 2022

(51) Int. Cl.
*A61G 7/10* (2006.01)

(52) U.S. Cl.
CPC ..... *A61G 7/1001* (2013.01); *A61G 7/1019* (2013.01); *A61G 7/1048* (2013.01); *A61G 7/1055* (2013.01)

(58) Field of Classification Search
CPC ... A61G 7/1001; A61G 7/1019; A61G 7/1048
See application file for complete search history.

(56) References Cited

U.S. PATENT DOCUMENTS

| | | | | |
|---|---|---|---|---|
| 4,475,256 | A * | 10/1984 | Hatala | A61G 7/1092 248/500 |
| 5,937,959 | A * | 8/1999 | Fujii | A61G 5/047 180/12 |
| 8,480,100 | B2 | 7/2013 | Staggs | |
| 8,794,252 | B2 | 8/2014 | Alghazi | |
| 2018/0055705 | A1* | 3/2018 | Sineath, Jr | A61G 7/1007 |
| 2022/0151850 | A1* | 5/2022 | Tiu | A61G 7/1017 |

FOREIGN PATENT DOCUMENTS

| | | | | |
|---|---|---|---|---|
| WO | WO-0121128 | A1 * | 3/2001 | A61G 5/125 |
| WO | WO-2018144100 | A1 * | 8/2018 | A61G 5/10 |
| WO | WO-2020258435 | A1 * | 12/2020 | A61G 7/10 |

* cited by examiner

*Primary Examiner* — Robert G Santos
*Assistant Examiner* — Adam C Ortiz
(74) *Attorney, Agent, or Firm* — Sanchelima & Associates, P.A.; Christian Sanchelima; Jesus Sanchelima

(57) ABSTRACT

A mobility aid including a body assembly, a handle assembly, and electrical assembly. Said body assembly includes a base portion having wheels with locking mechanisms, a telescopic central portion, and a top portion having telescopic portions. The telescopic portions are capable of being extended a predetermined length. The handle assembly includes handles mounted on the top portion. The handles are removable by means of straps attached at the base of each handle. Said straps can be locked when extended. A controller from the electrical assembly performs preconfigured actions such as extend or contract the telescopic members, drive the wheels in a desired direction. The handles are configured to secure a patient in a supine position to the pulled the patient by means of the straps and the wheels to place the patient in a lateral position and permit a caretaker to perform personal care on the patient.

12 Claims, 5 Drawing Sheets

MOBILITY AID

BACKGROUND OF THE INVENTION

1. Field of the Invention

The present invention relates to a mobility aid and, more particularly, to a mobility aid that helps caretakers to easily perform personal care on immobilized patients.

2. Description of the Related Art

Several designs for mobility aid have been designed in the past. None of them, however, include an electric controller for driving a four-wheeled base, with each wheel having a locking mechanism, in a desire direction.

Applicant believes that a related reference corresponds to U.S. Pat. No. 8,480,100 issued for an apparatus for providing mobility and support to a patient in a restaurant or a shower. Applicant believes that another related reference corresponds to U.S. Pat. No. 8,794,252 issued for a portable, folded, and multifunction mobility aid. None of these references, however, teach of mobility aid that includes a four-wheeled base that supports a central telescopic post with an electric controller on the top and a horizontal support bar with two handles, said controller drives the wheels in a desire direction and is used to adjust the height of the central post.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a mobility aid that is helpful for all the CNAs when completing patient/resident personal care.

It is another object of this invention to provide a mobility aid that provides CNAs the means for holding patients that are incontinent in a lateral position for a while without needing any other help.

It is still another object of the present invention to provide a mobility aid that provides a suitable way for CNAs to clean incontinent patients.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
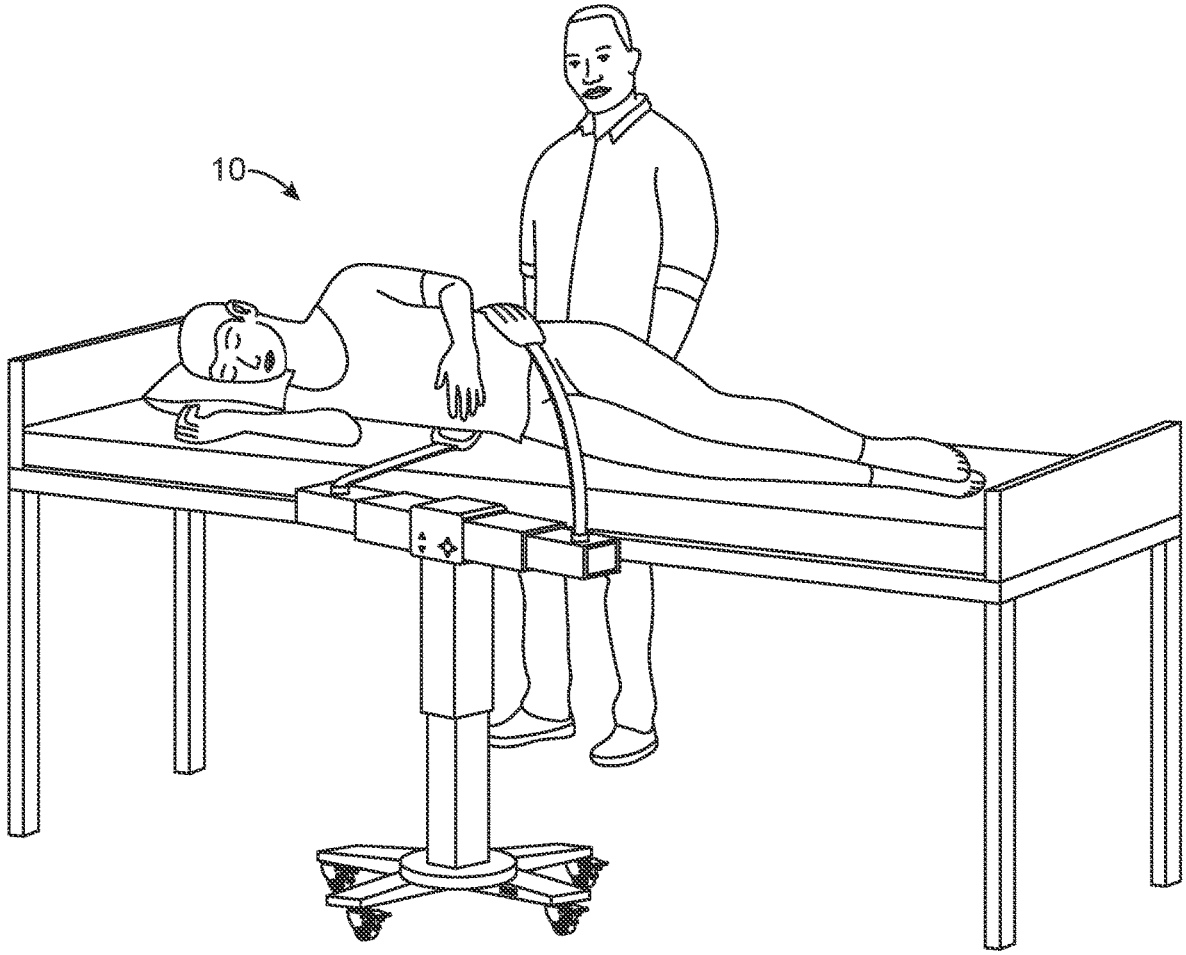
FIG. 1 represents an operational view of the present invention 10 wherein a patient is in supine position and a handle with a strap is placed across the patient chest to then be pulled at a lateral position so a caretaker can perform personal care on the patient.

Referring now to the drawings, where the present invention is generally referred to with numeral 10, it can be observed that it basically includes a body assembly 20, a handle assembly 40, an electrical assembly 60, and a wheel assembly 80. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The body assembly 20 includes a base portion 21, a central portion 22, and a top portion 23. Base portion 21 may be made of a hard, resistant, durable material. Base portion 21 may be made of steel, carbon steel, aluminum, alloy steel, stainless steel, metal, polymers, fibers, metal alloys, or any variation thereof. Base portion 21 may have members 24 that may protrude outwardly from said base portion 21. In a suitable embodiment base portion 21 may have a rectangular shape, nonetheless, in other embodiments base portion 21 may have a circular shape, a quadrangular shape, a cylindrical shape, an irregular shape, or any variation thereof. Each of the members 24 may have a cuboid shape, nonetheless, in other embodiments each member 24 may have an elongated shape, a cylindrical shape, or the like. Each member 24 may include a distal end 24*a*. The central portion 22 may be centrally mounted on top of the base portion 21. Central portion 22 may be placed vertically on top of the base portion 21. Central portion 22 may be an elongated shape. In one embodiment the central portion 22 may have a cuboid shape, however, in other embodiments the central portion 22 may have a cylindrical shape, a conic shape, a pyramid shape, an irregular elongated shape, or any variation thereof. Central portion 22 may be made of a resistant, sturdy, durable material. Central portion 22 may be made of polymers, metal, metal alloys, metal variants, fibers, or any variation thereof. Central portion 22 may be telescopic, meaning it can be extended a predetermined length from a rest state defining an extended configuration 22*a*. Said central portion 22 when in rest position may define a contracted configuration 22*b*. The central portion 22 may include a central actuation mechanism 25 to extend or contract the central portion 22. Said central actuation mechanism 25 may be a hydraulic system, a pneumatic system, a mechanic system, or any suitable mechanism for actuating telescopic mechanisms as known in the art. The top portion 23 may be placed on top of the central portion opposite to said base portion 21. Top portion 23 may be placed vertically on top of said central portion 22. Top portion may have a cuboid shape. In other embodiments said central portion may have a cylindrical shape, an elongated prism shape, or any variation thereof. Top portion 23 may be made of a resistant, sturdy, durable material. Top portion 23 may be made of polymers, metal, metal alloys, metal variants, fibers, or any variation thereof. Top portion 23 may include a right portion 26, and a left portion 27. Right portion 26 and left portion 27 may be telescopic, meaning both portions may lengthen from a rest position. Top portion 23 may include a top actuation mechanism 28 that actuate the right and left portion to be in lengthened configuration 23*a* or in shrunk configuration 23*b*.

Figure 2:
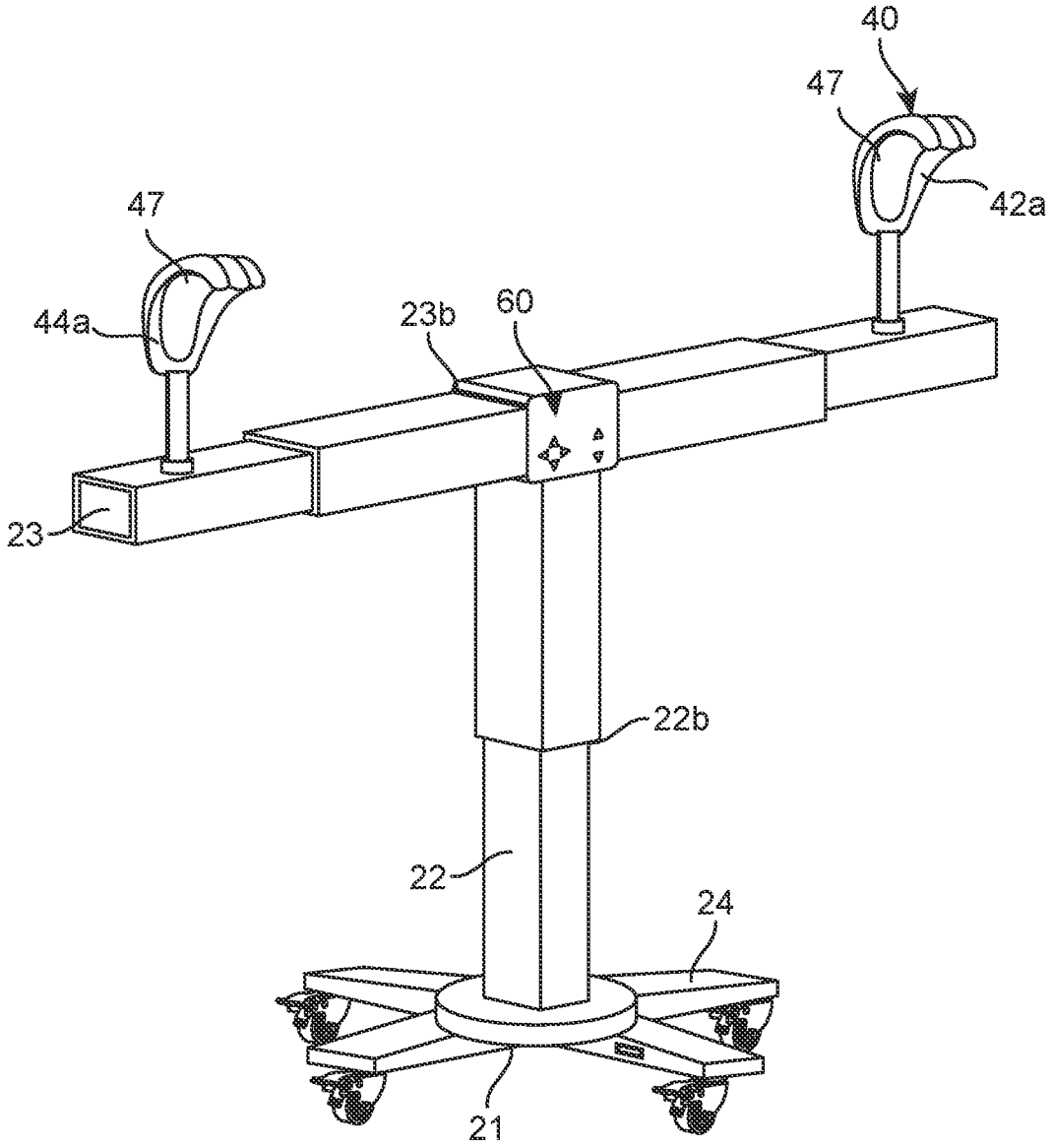
FIG. 2 shows an isometric view of the body assembly 20 showing the base portion 21 having members 24 with wheels 82 attached therein, a central portion 22, and a top portion 23. The handles 42 and 44 from the handle assembly 40 are attached to said top portion by means of retractable straps 46. Each handle includes an interior surface 42*a* and 44*a* which receives pads 47 thereat. A controller 62 from the electrical assembly 60 is configured to permit the mobility aid 10 to perform preconfigured actions.
Figure 3:
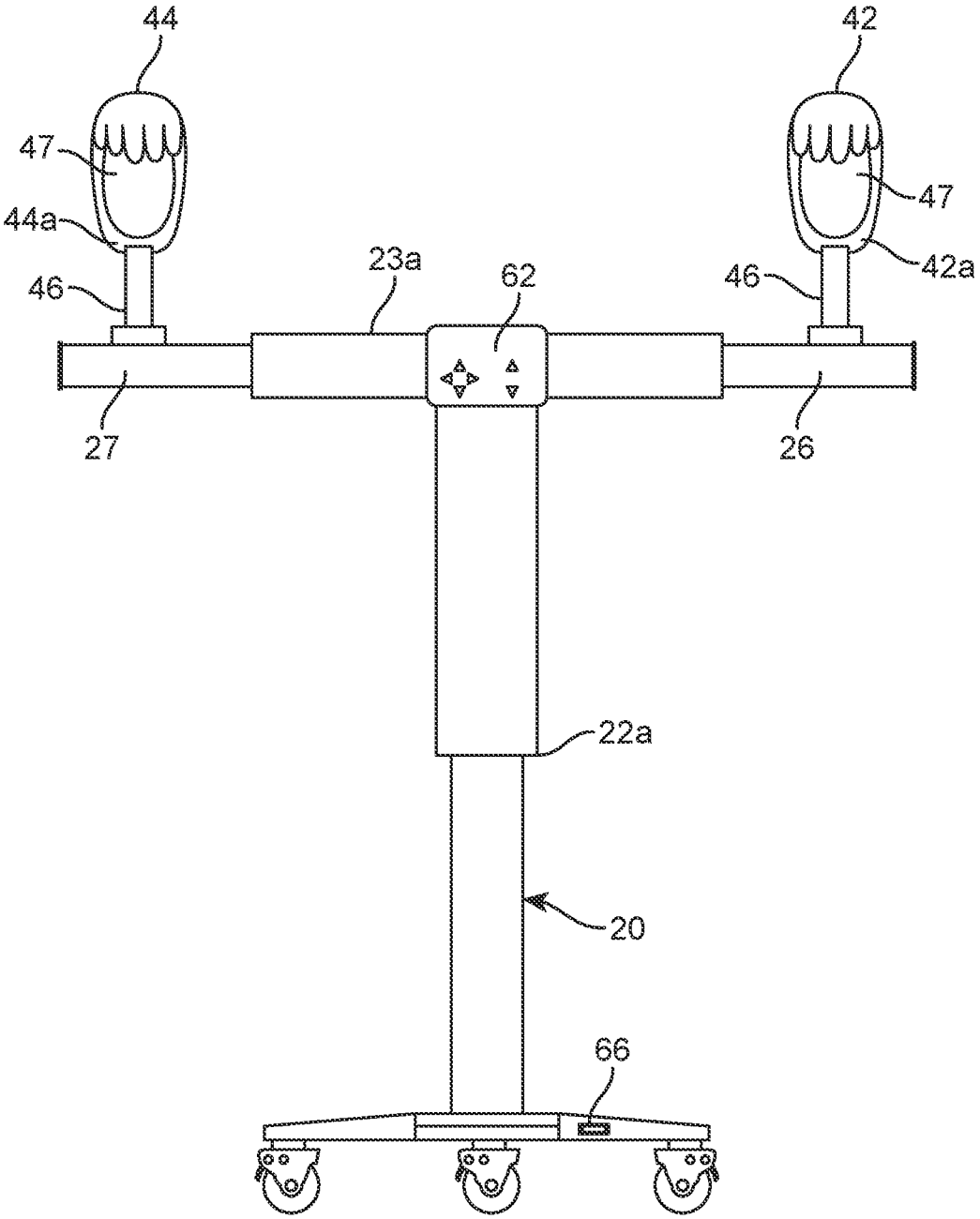
FIG. 3 illustrates the central portion 22 in extended configuration 22*a* as well as the right portion 26 and the left portion 27 in lengthened configuration 23*a*.

The handle assembly 40 includes a first handle 42, and a second handle 44. As shown in FIG. 2 said first and second handle are mounted on top of each right portion 26 and left portion 27 respectively. The first handle 42 and the second handle 44 may have a substantially hand shape, nevertheless, in other embodiments the handles 42 and 44 may have a different shape such as an upside-down L shape, or any shape that may be suitable for holding a lay-down user. First handle 42 and second handle 44 further including an interior surface 42*a* and 44*a*. Each interior surface 42*a* and 44*a* having a concave shape. Handles 42 and 44 may be made of a comfortable but resistant and sturdy material. Handle assembly 40 also includes straps 46 connected at the base of each handle 42 and 44. Straps 46 are capable of being extended and retracted, meaning that the straps 46 permit the handles 42 and 46 to be movable from the top portion 23. The straps 46 may be able to be locked when extended or when retracted defining adjustable straps. The straps 46 may be made of a highly resistant material. Straps 46 may resist high tension forces. Straps 46 may be made of cloth, rubber, leather, polymers, fibers, or the like. As depicted in FIG. 2 and FIG. 3 the handle assembly 40 further includes pads 47. Said pads 47 may conform with the interior surfaces 42*a* and 44*a*. Said pads 47 may be made of leather, cloth, fabric, polymers, cotton, or the like. Pads 47 may be removably attached at said interior surfaces 42*a* and 44*a*. Pads 47 may be washable. Pads 47 may provide a soft and comfortable portion for each of the handles 42 and 44 to comfortably hold a user.

The electrical assembly 60 includes a controller 62, a battery 64, and a charging cord 66. As shown in FIG. 3 the controller 62 is placed centered in the top portion 23. Controller 62 may include buttons which allow a user to perform predetermined actions. Controller 62 permit preconfigured actions such as 62 actuation the central actuation mechanism 25 and the top actuation mechanism 23*c* to extend or contract central portion 22 and members 26, 27, displacement of the mobility aid 10 by means of wheels 82, activation of the locking mechanism 84 of the wheels 82. Battery 64 may be enclosed by a member 24 of the base portion 21, however battery may be located wheresoever in the mobility aid 10. Said battery 64 may be a zinc battery, a zinc-carbon battery, an alkaline battery, a lithium battery, or any variation thereof. Battery 64 may be rechargeable. Battery 64 may supply electric energy to the controller 62 for it to perform the aforementioned preconfigured actions. The charging cord 66 may be placed in a member 24 of the base portion 21. However, the charging cord 66 may be located wheresoever in the mobility aid 10. Charging cord 66 is retractable, meaning it can be extended form a rest position to be connected to an external power source. Charging cord 66 may be connected to said battery 64 to recharge it.

Figure 4:
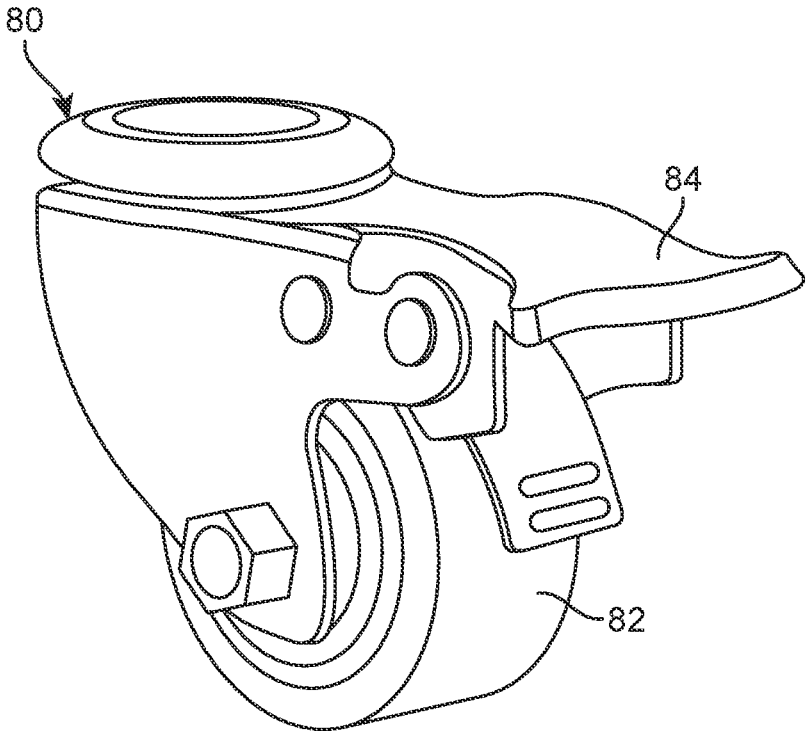
FIG. 4 is a representation of an enlarged view of one of the wheels 82 from the wheel assembly 80 having a locking mechanism 84. Wherein said locking mechanism can be actuated using the controller 62. Controller 62 may also steer the wheels 82 to a desire direction.
Figure 5:
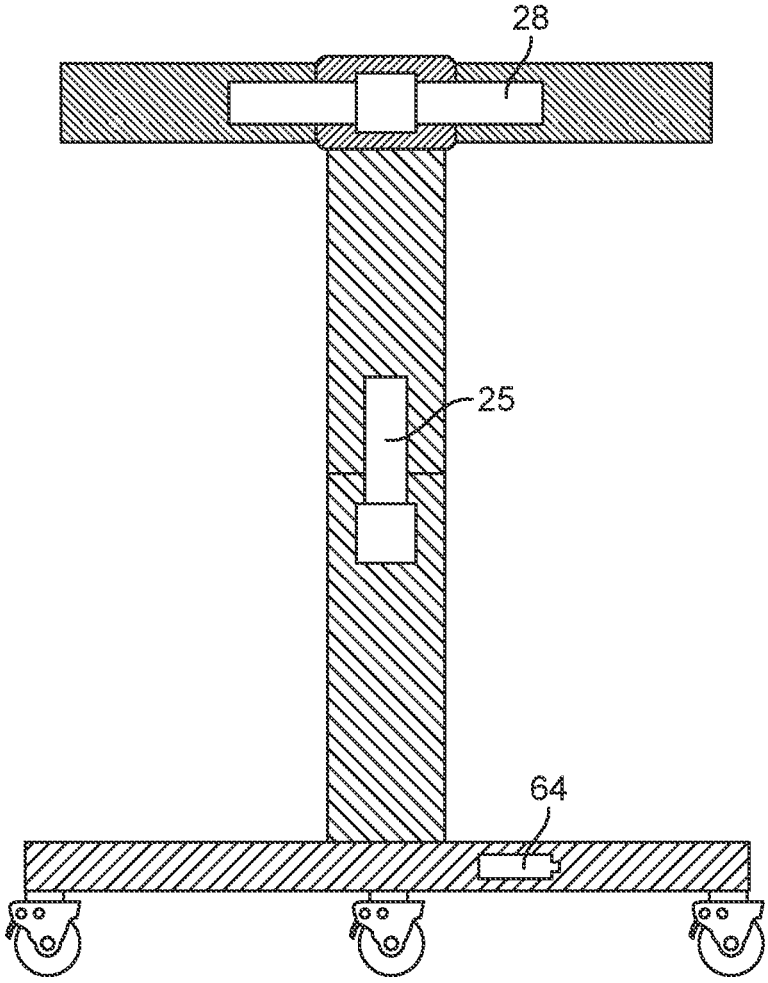
FIG. 5 depicts a cross section view of the central portion 22, the base portion 21 and top portion 23 wherein the top actuation mechanism 28, the central actuation mechanism 25, and the battery 64.

The wheel assembly 80 includes wheels 82. Each of the wheels 82 further includes a locking mechanism 84. Each of the wheels 82 may be located at said distal end 24*a* of each member 24. Wheels 82 may be made of polymers, metals, fibers, aluminum, metal alloys, metal variations, wooden materials, or any combination of the aforementioned materials. Wheels 82 permit to easily displace the mobility aid 10. The controller 62 may be connected to said wheels 82, the connection between elements may be done with electric cables. The controller 82 may drive the wheels 82 in a desire direction. The locking mechanism 84 block the wheels 82 to impede movement and leave the mobility aid 10 in a fixed position. Locking mechanism 84 may be attached to each of the wheels 82 as shown in FIG. 4.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mobility aid, comprising:

a) a body assembly including a base portion, a central portion mounted on top of the base portion, and a top portion mounted on top of the central portion, said central portion is telescopic, permitting the central portion to be lengthened or contracted a predetermined length, said top portion is placed horizontally on top of the central portion, the base portion has members, each of the members protrudes outwardly of the base portion defining a four-wheeled base;

b) a wheel assembly including wheels, wherein each of the wheels include a locking mechanism to prevent the wheels from moving freely, each of the wheels is mounted on each of the members; and c) a handle assembly including a first handle and a second handle, said first handle and second handle are mounted onto said top portion, the handle assembly also includes straps, said straps are connected at a base of the first handle and a base of the second handle, said first handle and said second handle are configured to hold a user in a predetermined position, wherein said straps are capable of being extended and retracted, the straps attached at the base of the first handle and the second handle permit each handle to be removable from the top portion;

d) an electrical assembly including a controller mounted on the top portion, said controller drives the wheels in a desired direction, said controller adjust a height of the central portion; and e) wherein said top portion has a right portion which is telescopic and a left portion which is telescopic, right portion and left portion are lengthened from a rest position, said top portion further includes a top actuation mechanism that actuate the right portion and left portion to be in a lengthened configuration or in a shrunk configuration.

2. The mobility aid of claim 1, wherein said central portion includes a central actuation mechanism that permits to extend or contract the central portion, when extended the central portion defines an extended configuration, when contracted the central portion defines a contracted configuration.

3. The mobility aid of claim 1, wherein said straps resist predetermined tension forces.

4. The mobility aid of claim 1, wherein said electrical assembly further includes a charging cord, wherein said charging cord is retractable.

5. The mobility aid of claim 1, wherein said electrical assembly includes a battery that supplies electric energy to said controller.

6. The mobility aid of claim 1, wherein said first handle is mounted on top of the right portion.

7. The mobility aid of claim 1, wherein said second handle is mounted on the left portion.

8. The mobility aid of claim 1, wherein said first handle has an interior surface, wherein pads are removably attached to said interior surface.

9. The mobility aid of claim 1, wherein said second handle has an interior surface, wherein pads are removably attached to said interior surface.

10. The mobility aid of claim 1, wherein said straps are adjustable.

11. A mobility aid, comprising:

a) a body assembly including a base portion, a central portion mounted on top of the base portion, and a top portion mounted on top of the central portion, said central portion is telescopic, permitting the central portion to be lengthened or contracted a predetermined length, said top portion is mounted orthogonally on top of the central portion, the base portion has members, each of the members protrudes outwardly for the base portion, said central portion includes a central actuation mechanism that permits to extend or contract the central portion, when extended the central portion defines an extended configuration, when contracted the central portion defines a contracted configuration, said top portion has a right portion which is telescopic and a left portion which is telescopic, right portion and left portion are lengthened from a rest position, said top portion further includes a top actuation mechanism that actuate the right portion and left portion to be in a lengthened configuration or in a shrunk configuration;

b) a wheel assembly including wheels, wherein each of the wheels include a locking mechanism to prevent the wheels from moving freely, each of the wheels is mounted on each of the members at a distal end;

c) a handle assembly including a first handle and a second handle, said first handle and second handle are mounted onto said top portion, the handle assembly also includes straps, said straps are connected at a base of the first handle and a base of the second handle, said straps are capable of being extended and retracted defining adjustable straps, the straps attached at the base of the first handle and the second handle permit each handle to be removable from the top portion, pads are removably attached at an interior surface of the first handle and an interior surface of the second handle; and d) an electrical assembly including a controller mounted on the top portion, said controller drives the wheels in a desired direction, the controller activates the top actuation mechanism and the central actuation mechanism, the electrical assembly further includes a battery and a charging cord, said battery provides electric energy to said controller, the charging cord is electrically connected to the battery, the charging cord permits to recharge the battery, the charging cord is retractable.

12. A mobility aid, consisting of:

a) a body assembly including a base portion, a central portion mounted on top of the base portion, and a top portion mounted on top of the central portion, said central portion is telescopic, permitting the central portion to be lengthened or contracted a predetermined length, said top portion is mounted orthogonally on top of the central portion, the base portion has members, each of the members protrudes outwardly for the base portion, said central portion includes a central actuation mechanism that permits to extend or contract the central portion, when extended the central portion defines an extended configuration, when contracted the central portion defines a contracted configuration, said top portion has a right portion which is telescopic and a left portion which is telescopic, right portion and left portion are lengthened from a rest position, said top portion further includes a top actuation mechanism that actuate the right portion and left portion to be in a lengthened configuration or in a shrunk configuration;

b) a wheel assembly including wheels, wherein each of the wheels include a locking mechanism to prevent the wheels from moving freely, each of the wheels is mounted on each of the members at a distal end;

c) a handle assembly including a first handle and a second handle, said first handle and second handle are mounted onto said top portion, the handle assembly also includes straps, said straps are connected at a base of the first handle and a base of the second handle, said straps are capable of being extended and retracted, the straps attached at the base of the first handle and the second handle permit each handle to be removable from the top portion; and d) an electrical assembly including a controller mounted on the top portion, said controller drives the wheels in a desired direction, the controller activates the top actuation mechanism and the central actuation mechanism, the electrical assembly further includes a battery and a charging cord, said battery provides electric energy to said controller, the charging cord is electrically connected to the battery, the charging cord permits to recharge the battery, the charging cord is retractable, said controller permits to lock the straps when extended.

* * * * *